US011497357B2

(12) United States Patent
Regalado

(10) Patent No.: US 11,497,357 B2
(45) Date of Patent: Nov. 15, 2022

(54) BED POSITIONABLE BATHING ASSEMBLY

(71) Applicant: Jane Regalado, Los Angeles, CA (US)

(72) Inventor: Jane Regalado, Los Angeles, CA (US)

( * ) Notice: Subject to any disclaimer, the term of this patent is extended or adjusted under 35 U.S.C. 154(b) by 0 days.

(21) Appl. No.: 17/217,457

(22) Filed: Mar. 30, 2021

(65) Prior Publication Data

US 2022/0313025 A1 Oct. 6, 2022

(51) Int. Cl.
*A47K 3/062* (2006.01)
*A61G 7/005* (2006.01)

(52) U.S. Cl.
CPC ..... *A47K 3/062* (2013.01); *A61G 7/005* (2013.01)

(58) Field of Classification Search
CPC ..... A61G 7/005; A61G 7/047; A47K 5/03; A47K 3/02–074; A47K 1/02–05
See application file for complete search history.

(56) References Cited

U.S. PATENT DOCUMENTS 2,567,514 A * 9/1951 Hoffman ..... A61G 7/0005 4/587
3,334,360 A 8/1967 Hoxeng
3,803,642 A 4/1974 Erling
4,024,590 A * 5/1977 Wendt ..... A61J 19/00 312/227
4,068,326 A 1/1978 Deschler
4,485,502 A * 12/1984 Marcanio ..... A61G 7/0005 4/585
4,785,486 A 11/1988 Viesturs
5,285,539 A 2/1994 Anderson
6,088,848 A * 7/2000 Waterlyn ..... A61G 7/0005 4/585
6,089,395 A * 7/2000 Karttunen ..... A63H 23/00 206/77.1
8,371,314 B1 * 2/2013 Herd ..... A45D 40/24 132/286
D743,514 S 11/2015 Kuipers
2005/0005350 A1 * 1/2005 Johnson ..... A61G 7/0005 4/585
2014/0325751 A1 * 11/2014 Hake ..... A47K 3/06 4/585

FOREIGN PATENT DOCUMENTS

GB 1389522 4/1975

* cited by examiner

*Primary Examiner* — David P Angwin
*Assistant Examiner* — Nicholas A Ros

(57) ABSTRACT

A bed positionable bathing assembly for bathing a bedridden user includes a sheet and a frame. The sheet is substantially impervious to water. The sheet comprises a bottom and a sidewall. The sidewall extends from a circumference of the bottom. The sheet is flexible so that the sidewall is positionable substantially coplanarly with the bottom. The sheet is positionable between a mattress and a user positioned on the mattress. The frame has a lower limit, which is positionable upon the sheet so that the frame surrounds the user. The frame has an upper limit, which is selectively engageable to an upper perimeter of the sidewall so that the sidewall extends transversely or substantially perpendicularly from the bottom and the mattress. The sheet thus defines a reservoir, which can collect water used in bathing the user.

12 Claims, 5 Drawing Sheets

BED POSITIONABLE BATHING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to bathing assemblies and more particularly pertains to a new bathing assembly for bathing a bedridden user. The present invention discloses a bathing assembly comprising a collapsible tub positionable upon a bed and supported by a frame, which also is positionable upon the bed.

(2) Description of Related Art Including Information Disclosed Under 37 CFR 1.97 and 1.98

The prior art relates to bathing assemblies. Prior art bathing assemblies may comprise collapsible tubs positionable on beds and supported by frames extending around upper circumferences of the tubs and supported by engagement to either bedframes or extensions to floors adjacent to the beds, or by walled enclosures positionable around the collapsible tubs. Prior art bathing assemblies also may comprise foldable or inflatable tubs positionable on beds. What is lacking in the prior art is bathing assembly comprising a collapsible tub positionable upon a bed and supported by a frame, which also is positionable upon the bed.

BRIEF SUMMARY OF THE INVENTION

An embodiment of the disclosure meets the needs presented above by generally comprising a sheet and a frame. The sheet is substantially impervious to water. The sheet comprises a bottom and a sidewall. The sidewall extends from a circumference of the bottom. The sheet is flexible so that the sidewall is positionable substantially coplanarly with the bottom and thus the sheet is configured to be positioned between a mattress and a user positioned on the mattress.

The frame has a lower limit configured to be positioned upon the sheet so that the frame surrounds the user. The frame has an upper limit configured to be selectively engageable to an upper perimeter of the sidewall so that the sidewall extends transversely or substantially perpendicularly from the bottom and the mattress. The sheet thus defines a reservoir configured to collect water used in bathing the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
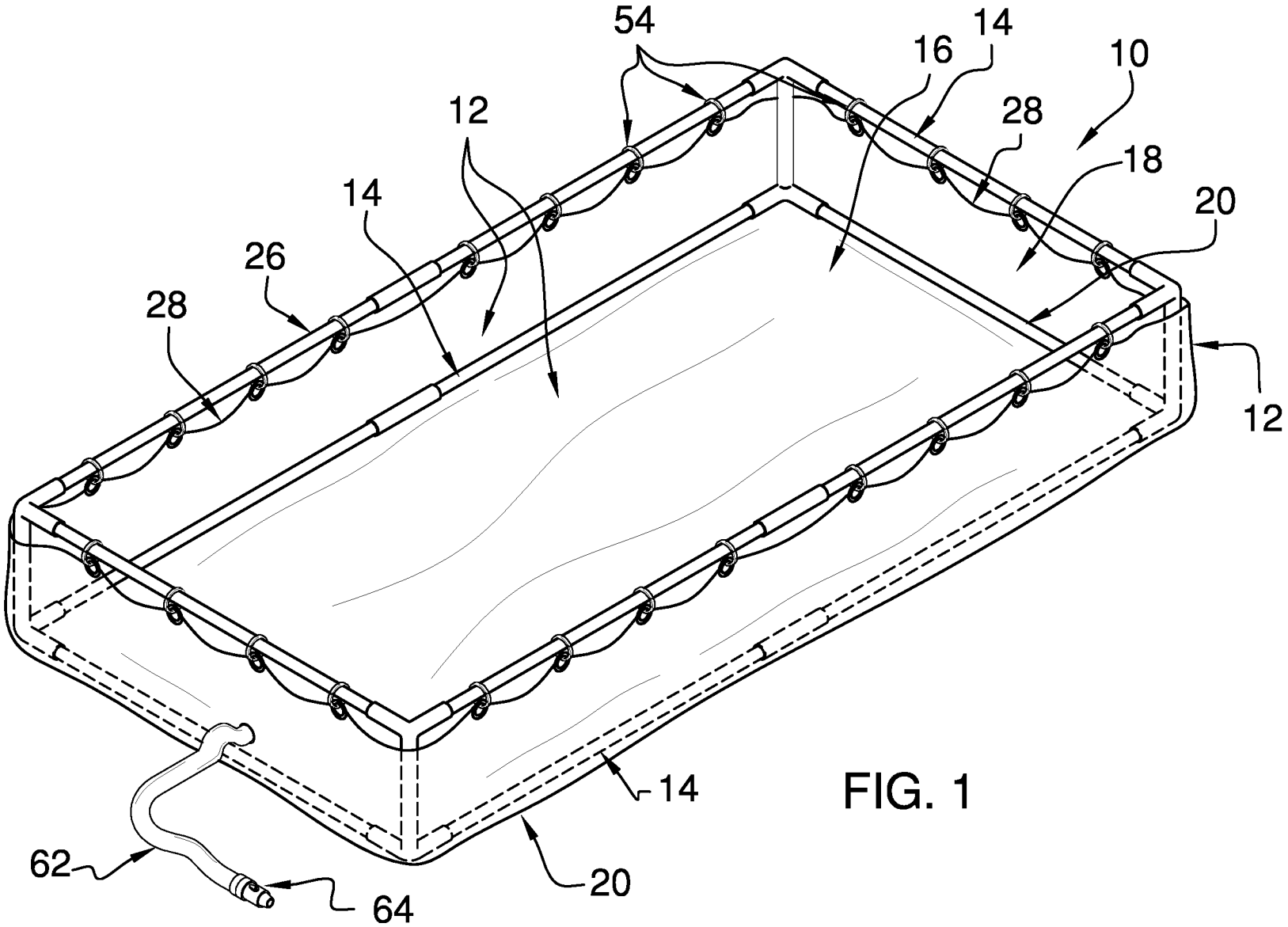
FIG. 1 is an isometric perspective view of a bed positionable bathing assembly according to an embodiment of the disclosure.

With reference now to the drawings, and in particular to FIGS. 1 through 6 thereof, a new bathing assembly embodying the principles and concepts of an embodiment of the disclosure and generally designated by the reference numeral 10 will be described.

As best illustrated in FIGS. 1 through 6, the bed positionable bathing assembly 10 generally comprises a sheet 12 and a frame 14. The sheet 12 is substantially impervious to water. The sheet 12 comprises a bottom 16 and a sidewall 18. The sidewall 18 extends from a circumference 20 of the bottom 16. The sheet 12 is flexible so that the sidewall 18 is positionable substantially coplanarly with the bottom 16. The sheet 12 thus is configured to be positioned between a mattress 22 and a user positioned on the mattress.

The frame 14 has a lower limit 24 configured to be positioned upon the sheet 12 22 so that the frame 14 surrounds the user. The frame 14 has an upper limit 26 configured to be selectively engageable to an upper perimeter 28 of the sidewall 18 so that the sidewall 18 extends transversely or substantially perpendicularly from the bottom 16 and the mattress 22. The sheet 12 thus defines a reservoir 30, which is configured to collect water used in bathing the user.

The frame 14 comprises a plurality of sections 32, which are selectively interconnectable. The plurality of sections 32 comprises a set of corner posts 34, a set of end rails 36, and a set of siderails 38. Each corner post 34 has a plurality of connectors 40 engaged to it and positioned two apiece proximate to an upper end 42 and a lower end 44 of the corner post 34. Each end rail 36 and each siderail 38 is selectively engageable to respective connectors 40 positioned on adjacent corner posts 34 so that the frame 14 is substantially rectangularly box shaped.

Each connector 40 comprises a pipe 46. The pipes 46 positioned proximate to the upper end 42 are perpendicular to each other and the corner post 34. The pipes 46 positioned proximate to the lower end 44 are perpendicular to each other and the corner post 34. The end rails 36 and the siderails 38 are circumferentially complementary to the pipes 46 and thus are selectively insertable into the pipes 46 to removably engage the end rails 36 and the siderails 38 to the adjacent corner posts 34. The present invention also anticipates other connecting means for securing the end rails 36 and the siderails 38 to the corner post 34, such as, but not limited to, snap connections, screws, and the like.

Each siderail 38 comprises a pair of segments 48 and a coupler 50, which is configured to mutually engage the segments 48. The coupler 50 comprises a tube 52, which is circumferentially complementary to the segments 48. The segments 48 are selectively insertable into the tube 52 to mutually engage the segments 48 in a linear configuration.

Figure 2:
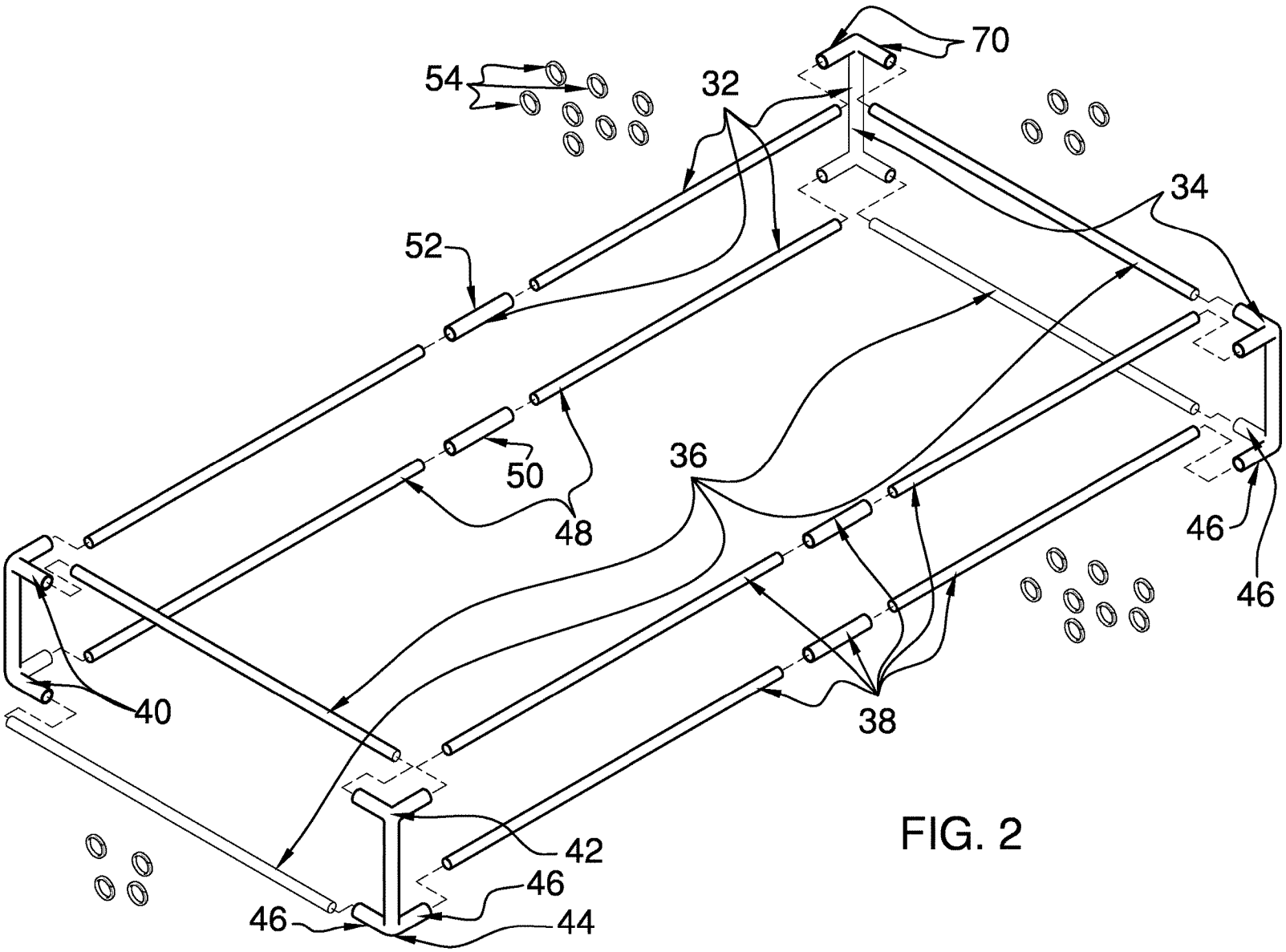
FIG. 2 is an exploded view of an embodiment of the disclosure.
Figure 3:
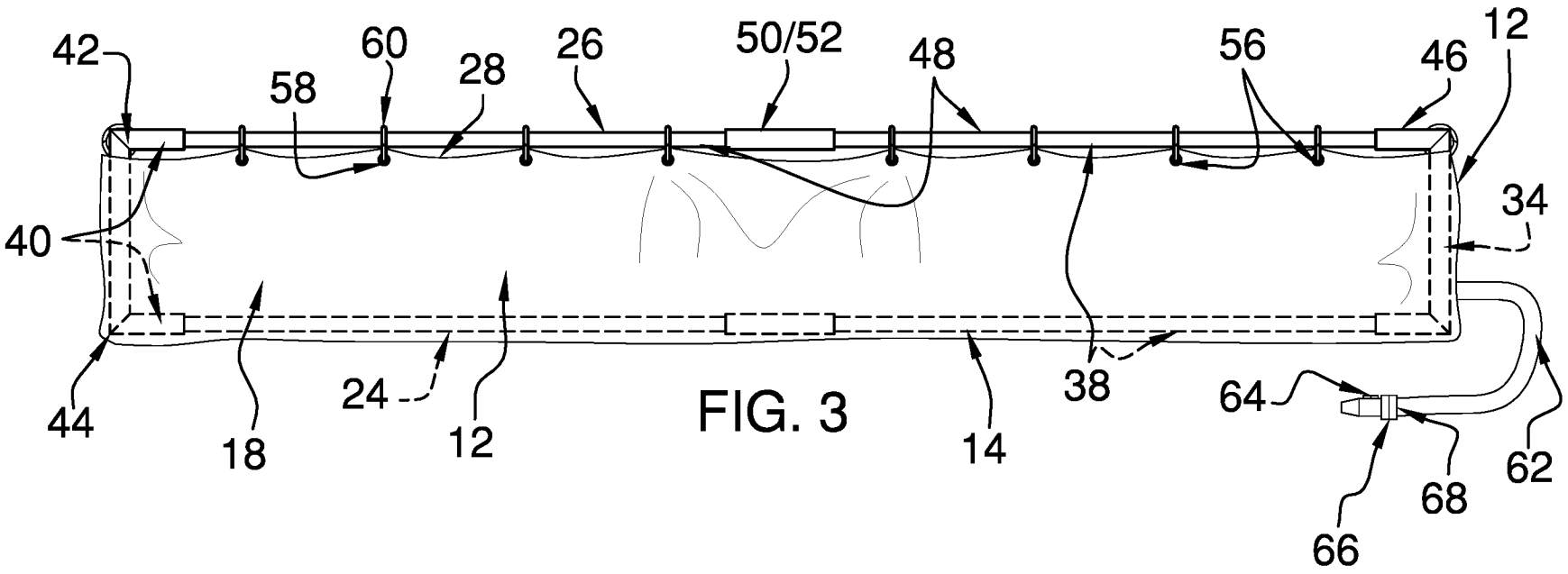
FIG. 3 is a side view of an embodiment of the disclosure.
Figure 4:
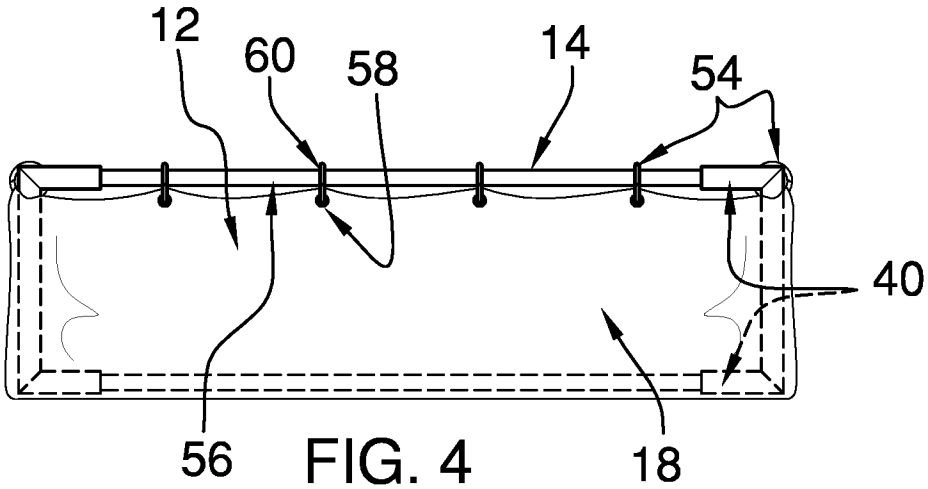
FIG. 4 is an end view of an embodiment of the disclosure.
Figure 5:
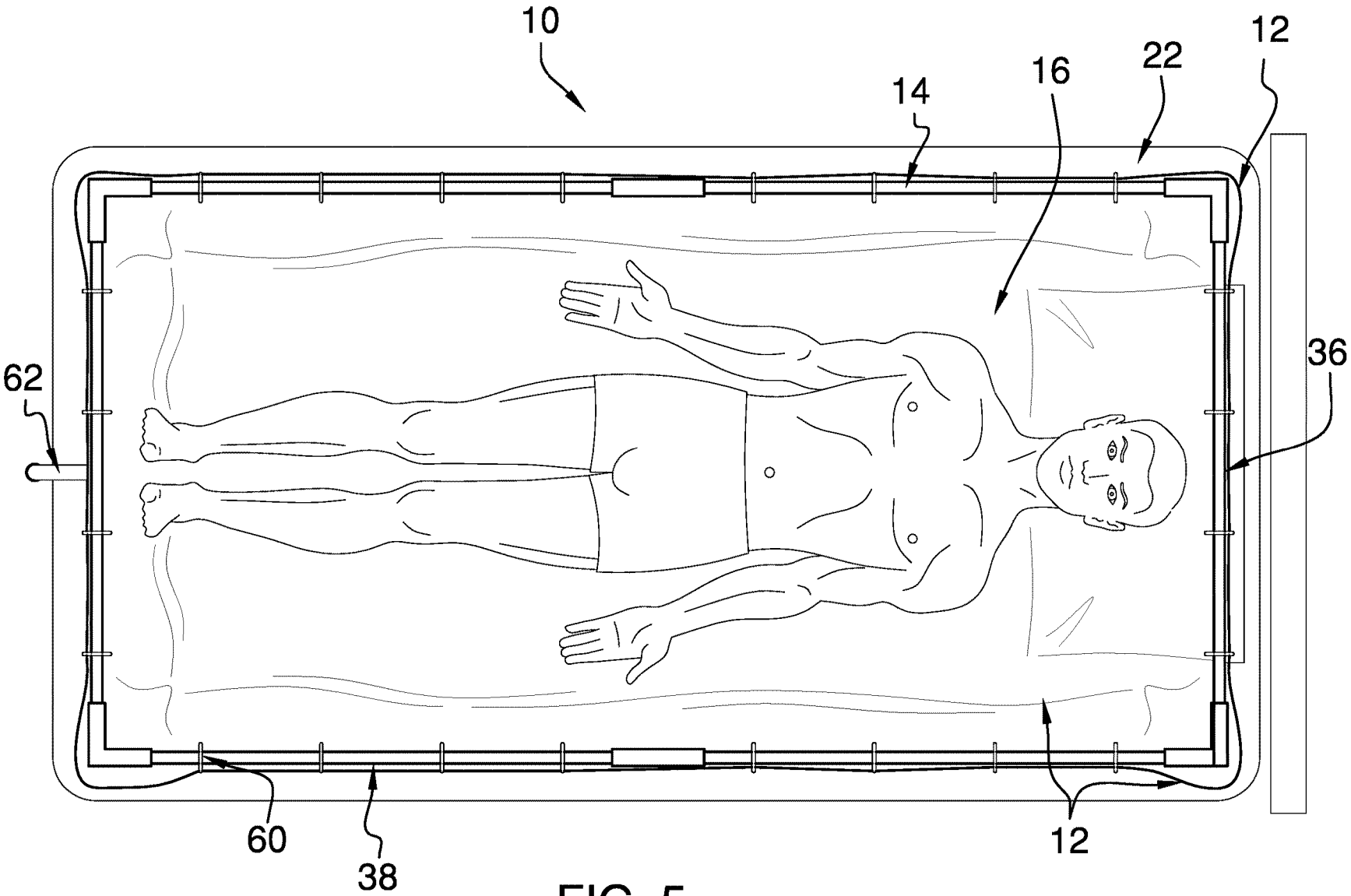
FIG. 5 is an in-use view of an embodiment of the disclosure.
Figure 6:
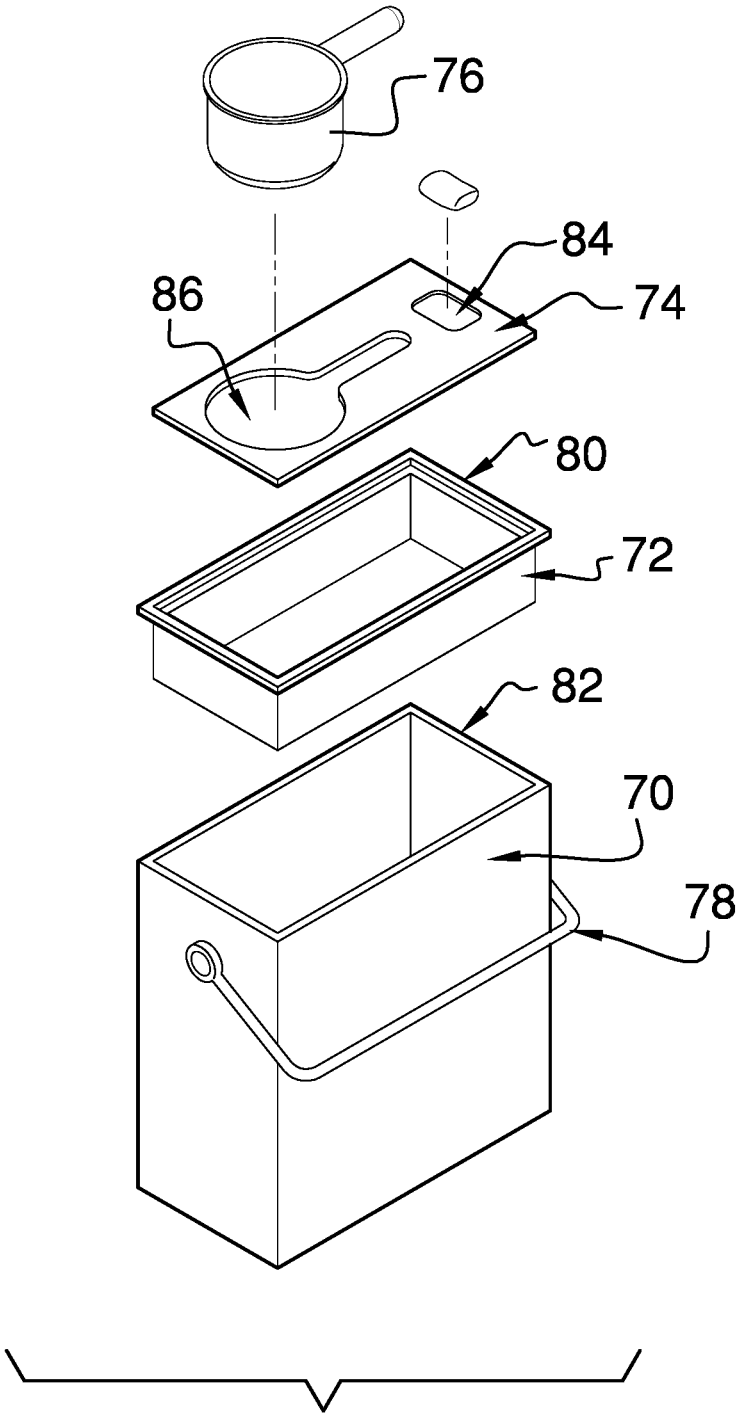
FIG. 6 is a kit view of an embodiment of the disclosure.

A plurality of first fasteners 54 is engaged to respective end rails 36 and to respective siderails 38 defining the upper limit 26 of the frame 14, as shown in FIG. 5. A plurality of second fasteners 56 is engaged to the sidewall 18 and extends around the upper perimeter 28, as shown in FIGS. 3 and 4. The second fasteners 56 are complementary to the first fasteners 54 so that each second fastener 56 is positioned to selectively engaged a respective first fastener 54 to removably engage the sidewall 18 to the frame 14. Each second fastener 56 comprises a grommet 58. Each first fastener 54 comprises a curtain ring 60, as shown in FIG. 2, a curtain hook, or the like. By using curtain rings 60 for fastening the sheet 12 to the frame 14, the curtain rings 60 are readily detachable from the sheet 12 for laundering the sheet 12.

A hose 62 is engaged to and extends from the sidewall 18 proximate to the bottom 16 so that the hose 62 is in fluidic communication with the reservoir 30. The hose 62 is configured to drain water from the reservoir 30. A valve 64 operationally engaged to the hose 62 is positioned to selectively open and close the hose 62. The valve 64 may comprise a quick connect 66 selectively engageable to a terminus 68 of the hose 62 distal from the sidewall 18.

The assembly 10 also may comprise a pail 70, a basin 72, a lid 74, and a dipper 76. A handle 78 is hingedly engaged to the pail 70. A lip 80 is engaged and extends radially from the basin 72. The lip 80 engages a top 82 of the pail 70 upon insertion of the basin 72 so that the basin 72 is removably engaged to the pail 70. The lid 74 is selectively engageable to the basin 72 to close the basin 72.

The dipper 76 is configured to ladle water. For example, fresh water positioned in the pail 70 can be ladled onto the user in the bathing process. Upon completion of bathing, the wastewater collected in the reservoir 30 can be drained through the hose 62 into the pail 70.

A first recess 84 and a second recess 86 extend into the lid 74. The first recess 84 is configured to stow of a bar of soap. The second recess 86 is shaped complementarily to the dipper 76 so that the dipper 76 is stowable in the second recess 86.

In use, the sheet 12 is positioned upon the mattress 22 adjacent to the user with the sidewall 18 folded flat to the bottom 16. The sheet 12 then is positioned between the user and the mattress 22, a process which is facilitated by rolling the user to their side or lifting the user to a seated position. The frame 14 then is assembled upon the sheet 12 and engaged to the frame 14 using the curtain rings 60. Upon completion of bathing, the wastewater collected in the reservoir 30 can be drained through the hose 62 into the pail 70 or into a drain. The frame 14 then can be disengaged from the sheet 12 and moved intact from the mattress 22, or the assembly process for the frame 14 can be reversed in whole or in part. Finally, the sheet 12 is removed from between the user and the mattress 22.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bed positionable bathing assembly comprising:

a sheet comprising a bottom and a sidewall, the sidewall extending from a circumference of the bottom, the sheet being flexible such that the sidewall is positionable coplanarly with the bottom, wherein the sheet is configured for positioning between a mattress and a user positioned on the mattress, the sheet being impervious to water;

a frame having a lower limit configured for positioning upon the sheet, such that the frame surrounds the user, the frame having an upper limit configured to be selectively engageable to an upper perimeter of the sidewall, such that the sidewall extends transversely or perpendicularly from the bottom and the mattress, such that the sheet defines a reservoir, wherein the reservoir is configured for collecting water used in bathing the user;

a handle hingedly engaged to a pail;

a lip engaged and extending radially from a basin, such that the lip engages a top of the pail upon insertion of the basin, such that the basin is removably engaged to the pail;

a lid selectively engageable to the basin for closing the basin, a first recess and a second recess extend into the lid, wherein the first recess is configured for stowing of a bar of soap; and a dipper configured for ladling of water, the second recess being shaped complementarily to the dipper, such that the dipper is stowable in the second recess.

2. The bed positionable bathing assembly of claim 1, wherein:

each second fastener comprises a grommet; and each first fastener comprises a curtain ring.

3. The bed positionable bathing assembly of claim 1, further including:

a hose engaged to and extending from the sidewall proximate to the bottom, such that the hose is in fluidic communication with the reservoir, wherein the hose is configured or draining water from the reservoir; and a valve operationally engaged to the hose, such that the valve is positioned for selectively opening and closing the hose.

4. The bed positionable bathing assembly of claim 3, wherein the valve comprises a quick connect selectively engageable to a terminus of the hose distal from the sidewall.

5. The bed positionable bathing assembly of claim 1, wherein the frame comprises a plurality of sections, the sections being selectively interconnectable.

6. The bed positionable bathing assembly of claim 5, wherein the plurality of sections comprises:

a set of corner posts, each corner post having a plurality of connectors engaged thereto and positioned two apiece proximate to an upper end and a lower end of the corner post;

a set of end rails, each end rail being selectively engageable to respective connectors positioned on adjacent corner posts; and a set of siderails, each siderail being selectively engageable to respective connectors positioned on adjacent corner posts, such that the frame is rectangularly box shaped.

7. The bed positionable bathing assembly of claim 6, wherein:

each connector comprises a pipe, the pipes positioned proximate to the upper end being perpendicular to each other and the corner post, the pipes positioned proximate to the lower end being perpendicular to each other and the corner post;

the end rail being circumferentially complementary to the pipes, such that the end rail selectively insertable into respective pipes for removably engaging the end rail to the adjacent corner posts; and the siderail being circumferentially complementary to the pipes, such that the siderail selectively insertable into respective pipes for removably engaging the siderail to the adjacent corner posts.

8. The bed positionable bathing assembly of claim 6, further including:

a plurality of first fasteners engaged to respective end rails and respective siderails defining the upper limit of the frame; and a plurality of second fasteners engaged to the sidewall and extending around the upper perimeter, the second fasteners being complementary to the first fasteners, such that each second fastener is positioned for selectively engaging a respective first fastener for removably engaging the sidewall to the frame.

9. The bed positionable bathing assembly of claim 6, wherein each siderail comprising a pair of segments and a coupler configured for mutually engaging the segments.

10. The bed positionable bathing assembly of claim 6, wherein the coupler comprising a tube, the tube being circumferentially complementary to the segments, such that the segments are selectively insertable into the tube for mutually engaging the segments in a linear configuration.

11. A bed positionable bathing system comprising:

a bed comprising a mattress configured for positioning of a user on the mattress;

a sheet comprising a bottom and a sidewall, the sidewall extending from a circumference of the bottom, the sheet being flexible such that the sidewall is positionable coplanarly with the bottom, wherein the sheet is configured for positioning between the mattress and the user, the sheet being impervious to water;

a frame having a lower limit positionable upon the sheet, such that the frame surrounds the user, the frame having an upper limit configured to be selectively engageable to an upper perimeter of the sidewall, such that the sidewall extends transversely or perpendicularly from the bottom and the mattress, such that the sheet defines a reservoir, wherein the reservoir is configured for collecting water used in bathing the user;

a handle hingedly engaged to a pail;

a lip engaged and extending radially from a basin, such that the lip engages a top of the pail upon insertion of the basin, such that the basin is removably engaged to the pail;

a lid selectively engageable to the basin for closing the basin, a first recess and a second recess extend into the lid, wherein the first recess is configured for stowing of a bar of soap; and a dipper configured for ladling of water, the second recess being shaped complementarily to the dipper, such that the dipper is stowable in the second recess.

12. A bed positionable bathing assembly comprising:

a sheet comprising a bottom and a sidewall, the sidewall extending from a circumference of the bottom, the sheet being flexible such that the sidewall is positionable coplanarly with the bottom, wherein the sheet is configured for positioning between a mattress and a user positioned on the mattress, the sheet being impervious to water, a frame having a lower limit configured for positioning upon the sheet, such that the frame surrounds the user, the frame having an upper limit configured to be selectively engageable to an upper perimeter of the sidewall, such that the sidewall extends transversely or perpendicularly from the bottom and the mattress, such that the sheet defines a reservoir, wherein the reservoir is configured for collecting water used in bathing the user, the frame comprising a plurality of sections, the sections being selectively interconnectable, the plurality of sections comprising:

a set of corner posts, each corner post having a plurality of connectors engaged thereto and positioned two apiece proximate to an upper end and a lower end of the corner post, each connector comprising a pipe, the pipes positioned proximate to the upper end being perpendicular to each other and the corner post, the pipes positioned proximate to the lower end being perpendicular to each other and the corner post, a set of end rails, each end rail being selectively engageable to respective connectors positioned on adjacent corner posts, the end rail being circumferentially complementary to the pipes, such that the end rail selectively insertable into respective pipes for removably engaging the end rail to the adjacent corner posts, and a set of siderails, each siderail being selectively engageable to respective connectors positioned on adjacent corner posts, such that the frame is rectangularly box shaped, the siderail being circumferentially complementary to the pipes, such that the siderail selectively insertable into respective pipes for removably engaging the siderail to the adjacent corner posts, each siderail comprising a pair of segments and a coupler configured for mutually engaging the segments, the coupler comprising a tube, the tube being circumferentially complementary to the segments, such that the segments are selectively insertable into the tube for mutually engaging the segments in a linear configuration;

a plurality of first fasteners engaged to respective end rails and respective siderails defining the upper limit of the frame;

a plurality of second fasteners engaged to the sidewall and extending around the upper perimeter, the second fasteners being complementary to the first fasteners, such that each second fastener is positioned for selectively engaging a respective first fastener for removably engaging the sidewall to the frame, each second fastener comprising a grommet, each first fastener comprising a curtain ring;

a hose engaged to and extending from the sidewall proximate to the bottom, such that the hose is in fluidic communication with the reservoir, wherein the hose is configured or draining water from the reservoir;

a valve operationally engaged to the hose, such that the valve is positioned for selectively opening and closing the hose, the valve comprising a quick connect selectively engageable to a terminus of the hose distal from the sidewall;

a handle hingedly engaged to a pail;

a lip engaged and extending radially from a basin, such that the lip engages a top of the pail upon insertion of the basin, such that the basin is removably engaged to the pail;

a lid selectively engageable to the basin for closing the basin, a first recess and a second recess extend into the lid, wherein the first recess is configured for stowing of a bar of soap; and a dipper configured for ladling of water, the second recess being shaped complementarily to the dipper, such that the dipper is stowable in the second recess.

* * * * *